US007750783B2

(12) United States Patent
Hasegawa et al.

(10) Patent No.: US 7,750,783 B2
(45) Date of Patent: Jul. 6, 2010

(54) ELECTRONIC INSTRUMENT INCLUDING A COIL UNIT

(75) Inventors: Minoru Hasegawa, Suwa (JP); Masao Kuroda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/071,214

(22) Filed: Feb. 19, 2008

(65) Prior Publication Data

US 2008/0197956 A1 Aug. 21, 2008

(30) Foreign Application Priority Data

Feb. 20, 2007 (JP) ..... 2007-039885
Dec. 18, 2007 (JP) ..... 2007-325407

(51) Int. Cl.

*H01F 27/08* (2006.01)
*H01F 27/06* (2006.01)
*H01F 27/02* (2006.01)
*H01F 27/30* (2006.01)
*H01F 5/00* (2006.01)
*H01F 27/28* (2006.01)
*H01F 7/06* (2006.01)

(52) U.S. Cl. ..... 336/61; 336/65; 336/90; 336/179; 336/199; 336/200; 336/223; 336/232; 336/185; 29/602.1

(58) Field of Classification Search ..... None
See application file for complete search history.

(56) References Cited

U.S. PATENT DOCUMENTS 5,208,728 A * 5/1993 Schirmer ..... 361/752
6,008,622 A * 12/1999 Nakawatase ..... 320/108
6,501,364 B1 * 12/2002 Hui et al. ..... 336/200
7,012,414 B1 * 3/2006 Mehrotra et al. ..... 323/306
7,176,423 B2 * 2/2007 Kataoka et al. ..... 219/622
7,518,572 B2 * 4/2009 Kong et al. ..... 345/60
7,576,514 B2 * 8/2009 Hui ..... 320/108
2003/0020583 A1 1/2003 Hui et al.
2004/0233133 A1 * 11/2004 Kong et al. ..... 345/60
2008/0061917 A1 * 3/2008 Manoukian et al. ..... 336/200

FOREIGN PATENT DOCUMENTS

DE 196 27 819 A1 1/1998
EP 2006042519 * 9/2006
JP A-08-103028 4/1996
JP A-08-148360 6/1996
JP 10-173398 * 6/1998
JP 10-173398 * 10/1998

(Continued)

*Primary Examiner*—Elvin G Enad
*Assistant Examiner*—Mangtin Lian
(74) *Attorney, Agent, or Firm*—Oliff & Berridge, PLC

(57) ABSTRACT

A coil unit includes a planar coil, a magnetic member that is provided under the planar coil, a magnetic flux leakage prevention member that is provided under the magnetic member, and a heat sink that is provided under the magnetic flux leakage prevention member. The magnetic flux leakage prevention member is electrically insulated from the heat sink. The magnetic flux leakage prevention member is insulated from the heat sink using a double-sided adhesive tape, for example. Since the heat sink dissipates heat generated from the planar coil and is electrically insulated from the magnetic flux leakage prevention member, the heat sink does not function as a member which receives a magnetic flux.

8 Claims, 6 Drawing Sheets

FOREIGN PATENT DOCUMENTS

| | | | |
|---|---|---|---|
| JP | A-11-98705 | | 4/1999 |
| JP | 2003-272938 | * | 9/2003 |
| JP | A-2003-272938 | | 9/2003 |
| JP | A-2005-6460 | | 1/2005 |
| JP | A-2005-110357 | | 4/2005 |
| JP | A-2006-042519 | | 2/2006 |
| WO | WO 03/105308 | A1 | 12/2003 |
| WO | WO 2004/040599 | A1 | 5/2004 |
| WO | WO 2004/084372 | A1 | 9/2004 |

* cited by examiner

ELECTRONIC INSTRUMENT INCLUDING A COIL UNIT

Japanese Patent Application No. 2007-39885 filed on Feb. 20, 2007 and Japanese Patent Application No. 2007-325407 filed on Dec. 18, 2007, are hereby incorporated by reference in their entirety.

BACKGROUND OF THE INVENTION

The present invention relates to a coil unit relating to non-contact power transmission using a coil, a method of manufacturing the same, an electronic instrument, and the like.

Non-contact power transmission has been known which utilizes electromagnetic induction to enable power transmission without metal-to-metal contact. As application examples of non-contact power transmission, charging a portable telephone, a household appliance (e.g., telephone handset), and the like has been proposed.

Non-contact power transmission has a problem in that a transmission coil produces heat. Technologies which suppress such heat generation have been proposed. JP-A-8-103028 discloses a design method which suppresses heat generation during non-contact charging. JP-A-8-148360 discloses technology which suppresses heat generation by adapting a suitable configuration of a coil and a magnetic material. JP-A-11-98705 discloses a non-contact charging device provided with an air-cooling mechanism. JP-A-2003-272938 discloses a structure in which a ceramic is disposed between a primary coil and a secondary coil to dissipate heat. JP-A-2005-110357 discloses the structure of a housing with an improved heat dissipation capability.

Non-contact power transmission transmits power between coils utilizing a magnetic field. Therefore, when a metal is brought close to the magnetic field, the magnetic field is absorbed by the metal, whereby a decrease in efficiency or induction heating of the metal occurs. This makes it difficult to utilize a metal optimum for heat dissipation.

Some aspects of the invention may provide a coil unit which exhibits an excellent heat dissipation capability, a method of manufacturing the same, and an electronic instrument.

SUMMARY

According to one aspect of the invention, there is provided a coil unit comprising:

a planar coil;

a magnetic member that is provided under the planar coil;

a magnetic flux leakage prevention member that is provided under the magnetic member; and a heat sink that is provided under the magnetic flux leakage prevention member, the magnetic flux leakage prevention member being electrically insulated from the heat sink.

According to another aspect of the invention, there is provided an electronic instrument comprising:

the above coil unit; and a casing that receives the coil unit, the casing having a hole in a surface that faces the planar coil, the hole being covered with a protective cover;

the casing having a reinforcing section that is formed at a position that faces a maximum height position of the at least one mounted component, the reinforcing section having a thickness larger than that of the protective cover; and when a height of an outer surface of the protective cover from the printed circuit board is referred to as H1, a maximum height of at least one mounted component with respect to the printed circuit board is referred to as H2, and a thickness of the reinforcing section is referred to as H3, H1>H2+H3 being satisfied.

According to another aspect of the invention, there is provided a method of manufacturing the above coil unit, the method comprising:

(A) placing the planar coil, the magnetic member, and the magnetic flux leakage prevention member in that order in a receiving section of an assembly jig;

(B) placing the heat sink in the receiving section so as to electrically insulate the heat sink from the magnetic flux leakage prevention member after the step (A); and (C) positioning the printed circuit board to the assembly jig on an open side of the receiving section of the assembly jig after the step (B) to attach the planar coil, the magnetic member, the magnetic flux leakage prevention member, and the heat sink on the printed circuit board.

According to another aspect of the invention, there is provided a coil unit comprising:

a coil;

a magnetic member, a first magnetic flux that is produced by the coil entering the magnetic member;

a magnetic flux leakage prevention member, a second magnetic flux that is produced by the magnetic member based on the first magnetic flux entering the magnetic flux leakage prevention member; and a heat sink that dissipates heat generated from the coil, the magnetic flux leakage prevention member being electrically insulated from the heat sink.

DETAILED DESCRIPTION OF THE EMBODIMENT

Figure 1:
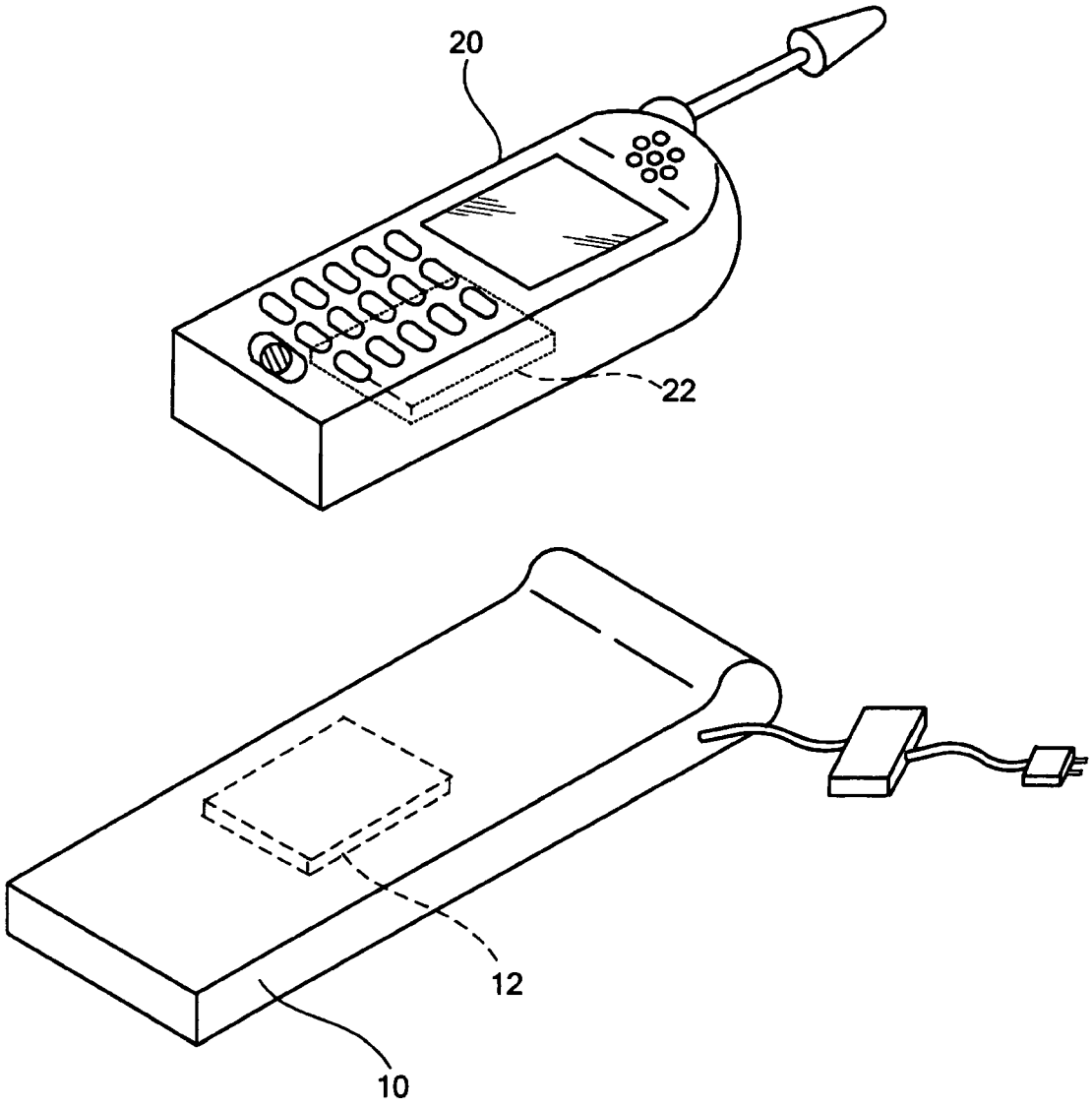
FIG. 1 is a view schematically showing a charger and a charging target.

According to one embodiment of the invention, there is provided a coil unit comprising:

a planar coil;

a magnetic member that is provided under the planar coil;

a magnetic flux leakage prevention member that is provided under the magnetic member; and a heat sink that is provided under the magnetic flux leakage prevention member, the magnetic flux leakage prevention member being electrically insulated from the heat sink.

According to this configuration, since the magnetic member and the magnetic flux leakage prevention member are provided between the planar coil and the heat sink (i.e., space is not provided between the planar coil and the heat sink), heat generated from the planar coil can be effectively dissipated. Moreover, since the magnetic flux leakage prevention member is provided, a situation in which the heat sink receives a magnetic flux and undergoes induction heating can be prevented. Since the magnetic flux leakage prevention member formed of a metal is electrically insulated from the heat sink which is also formed a metal, a situation in which the heat sink functions as a member which receives a magnetic flux can be prevented.

In the coil unit according to this embodiment, the magnetic flux leakage prevention member may be insulated from the heat sink through a double-sided adhesive tape.

According to this configuration, since the magnetic flux leakage prevention member is insulated from the heat sink using the double-sided adhesive tape, another insulator need not be provided. This facilitates assembly.

In the coil unit according to this embodiment, the coil unit may further comprising a printed circuit board having conductive patterns, the heat sink being provided on the printed circuit board and the conductive patterns that are connected to the planar coil being formed on the printed circuit board.

According to this configuration, since the conductive patterns are formed on the printed circuit board, an control element which controls the planar coil can be easily electrically connected.

In the coil unit according to this embodiment, the coil unit may further include at least one mounted component that is provided on the printed circuit board on a side that is provided with the heat sink, an upper side position of the planar coil may be set to be higher an upper side of a mounted component having a maximum height among the at least one mounted component.

According to this configuration, since the upper side position of the planar coil is set to be higher than the upper side of the mounted component, assembly is facilitated. Moreover, the upper side of the planar coil can be brought closer to the other coil unit.

In the coil unit according to this embodiment, a mounted component among the at least one mounted component that has the maximum height may be a capacitor that is connected to the planar coil. The size of the capacitor must be increased from the viewpoint of ensuring an electric capacitance. Therefore, this aspect of the invention is effective when the mounted component is a capacitor.

In the coil unit according to this embodiment, the coil unit may further include a temperature detection element that detects a temperature of the heat sink, the temperature detection element being provided on a side of the printed circuit board opposite to a side that is provided with the heat sink. This enables detection of an abnormality when the temperature of the heat sink increases to a large extent due to an increase in temperature of the coil due to insertion of a foreign object, for example.

In the coil unit according to this embodiment, the coil unit may further include an element that disconnects the planar coil from a power supply based on a temperature of the heat sink, the element being provided on a side of the printed circuit board opposite to a side that is provided with the heat sink. This enables a circuit that blocks power supply to be formed simply and reliably.

In the coil unit according to this embodiment, the printed circuit board may have a positioning section that is guided through an assembly jig, the assembly jig receiving the heat sink, the magnetic flux leakage prevention member, the magnetic member, and the planar coil. As a result, the planar coil and the like can be easily assembled.

In the coil unit according to this embodiment, the coil unit may further include a spacer member that is disposed on an upper side of the magnetic member, the spacer member may include a hole that receives the planar coil, an upper side of the planar coil being substantially flush with an upper side of the spacer member. The transmission side can be made flat by making the upper side of the planar coil substantially flush with the upper side of the spacer member. This also prevents a situation in which the planar coil breaks due to collision of a member with the edge of the planar coil.

In the coil unit according to this embodiment, the magnetic flux leakage prevention member and the heat sink may have a substantially identical planar size, and the heat sink may have a thickness larger than that of the magnetic flux leakage prevention member. A magnetic flux can be reliably captured by the magnetic leakage member when the heat sink has substantially the same planar size as the magnetic flux leakage prevention member. Moreover, the heat dissipation capability of the heat sink can be further increased by forming the heat sink to be thicker than the magnetic flux leakage prevention member.

According to another embodiment of the invention, there is provided an electronic instrument comprising:

the above coil unit; and a casing that receives the coil unit, the casing having a hole in a surface that faces the planar coil, the hole being covered with a protective cover;

the casing having a reinforcing section that is formed at a position that faces a maximum height position of the at least one mounted component, the reinforcing section having a thickness larger than that of the protective cover; and when a height of an outer surface of the protective cover from the printed circuit board is referred to as $H1$, a maximum height of at least one mounted component with respect to the printed circuit board is referred to as $H2$, and a thickness of the reinforcing section is referred to as $H3$, $H1>H2+H3$ being satisfied.

The mounted component can be reliably protected by the reinforcing section by reducing the thickness of the protective cover and increasing the thickness of the reinforcing section. The reinforcing section also prevents the casing from depressing over the mounted component so that the casing can be made flat near the transmission side. A space can be provided between the mounted component and the reinforcing section by satisfying the relationship $H1>H2+H3$, thereby preventing breakage of the mounted component.

According to a further embodiment of the invention, there is provided a method of manufacturing the above coil unit, the method comprising:

(A) placing the planar coil, the magnetic member, and the magnetic flux leakage prevention member in that order in a receiving section of an assembly jig;

(B) placing the heat sink in the receiving section so as to electrically insulate the heat sink from the magnetic flux leakage prevention member after the step (A); and (C) positioning the printed circuit board to the assembly jig on an open side of the receiving section of the assembly jig after the step (B) to attach the planar coil, the magnetic member, the magnetic flux leakage prevention member, and the heat sink on the printed circuit board.

According to this configuration, the planar coil, the magnetic member, the magnetic flux leakage prevention member, and the heat sink are placed in the assembly jig, and the planar coil and the like are then provided on the printed circuit board by stacking the printed circuit board. Therefore, assembly is facilitated as compared with the case of assembling the elements one by one.

In a manufacturing method according to another aspect of the invention, a member such as a double-sided adhesive tape is provided between members when placing the planar coil, the magnetic member, the magnetic leakage member, and the heat sink in the assembly jig. This method is also included within the scope of the invention.

In the method according to this embodiment, the method may further include placing an insulating double-sided adhesive tape between the step (A) and the step (B), the insulating double-sided adhesive tape electrically insulating the magnetic flux leakage prevention member from the heat sink.

In the method according to this embodiment, the method may further include placing a spacer member in the receiving section before the step (A). The spacer member may include a hole that receives the planar coil, an upper side of the planar coil being substantially flush with an upper side of the spacer member.

In the method according to this embodiment, the printed circuit board may have a positioning section, and the assembly jig may have a positioning guide section that corresponds to the positioning section of the printed circuit board. Positioning can be facilitated by providing the positioning section, whereby assembly is facilitated.

According to another embodiment of the invention, there is provided a coil unit comprising:

a coil;

a magnetic member, a first magnetic flux that is produced by the coil entering the magnetic member;

a magnetic flux leakage prevention member, a second magnetic flux that is produced by the magnetic member based on the first magnetic flux entering the magnetic flux leakage prevention member; and a heat sink that dissipates heat generated from the coil, the magnetic flux leakage prevention member being electrically insulated from the heat sink.

In the coil unit according to another aspect of the invention, since the magnetic member and the magnetic flux leakage prevention member are provided between the planar coil and the heat sink (i.e., space is not provided between the planar coil and the heat sink), heat generated from the planar coil can be effectively dissipated. Moreover, since the magnetic flux leakage prevention member is provided, a situation in which the heat sink receives a magnetic flux and undergoes induction heating can be prevented. Since the magnetic flux leakage prevention member formed of a metal is electrically insulated from the heat sink which is also formed a metal, a situation in which the heat sink functions as a member which receives a magnetic flux can be prevented. Various embodiments of the coil unit according to the above aspect of the invention may also be applied the coil unit according to this aspect of the invention.

According to another embodiment of the invention, there is provided an electronic instrument comprising the above coil unit.

Preferred embodiments of the invention are described in detail below. Note that the embodiments described below do not in any way limit the scope of the invention defined by the claims laid out herein. Note that all elements of the embodiments described below should not necessarily be taken as essential requirements for the invention.

FIG. 1 is a view schematically showing a charger 10 and a charging target 20. The charging target 20 is charged using the charger 10 by non-contact power transmission utilizing electromagnetic induction which occurs between a coil of a coil unit 12 of the charger 10 and a coil of a coil unit 22 of the electronic instrument 20.

This embodiment is characterized by the configuration of the coil unit. The coil unit is described in detail below.

Figure 2:
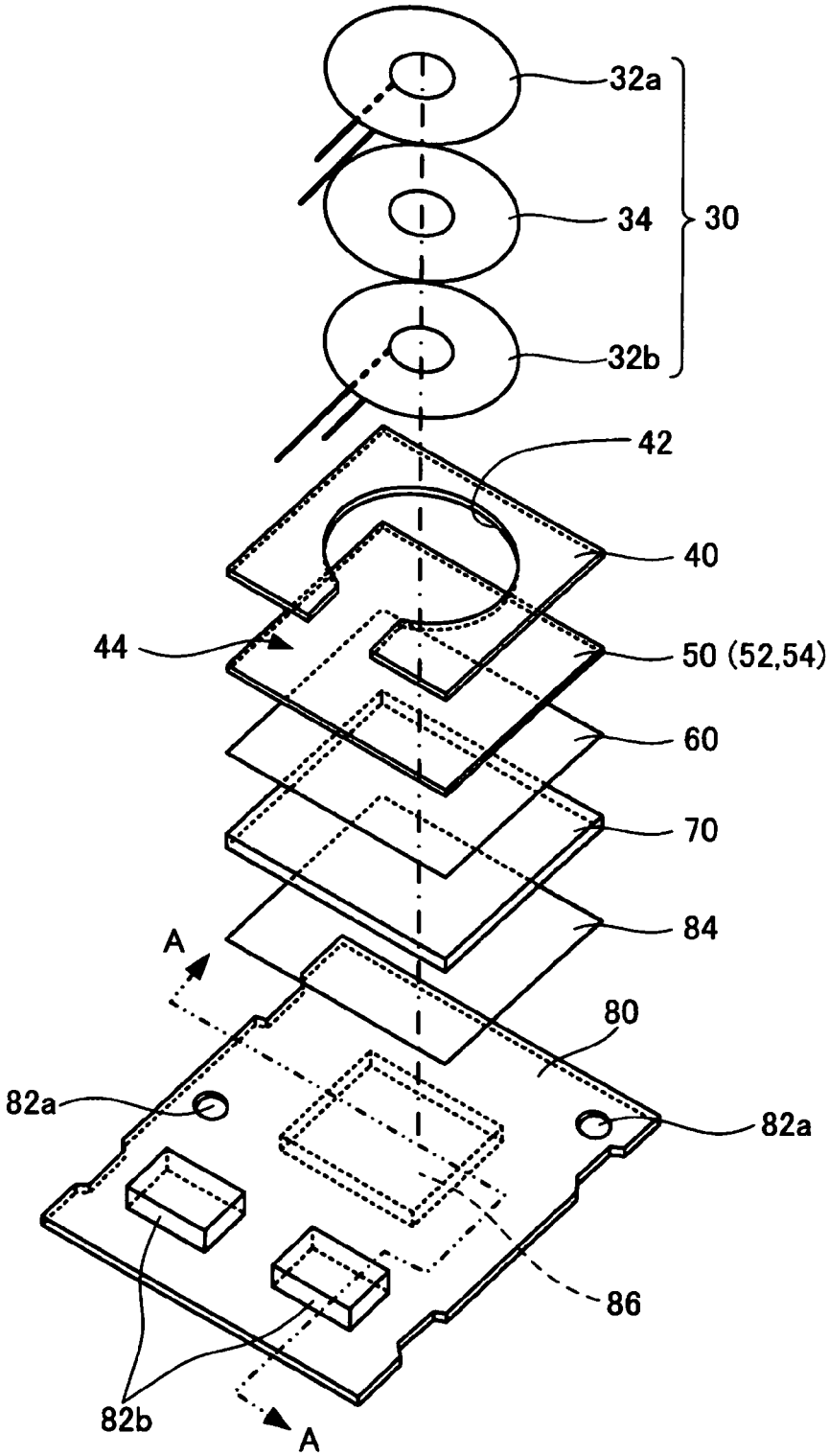
FIG. 2 is a schematic exploded oblique view showing a coil unit.
Figure 3:
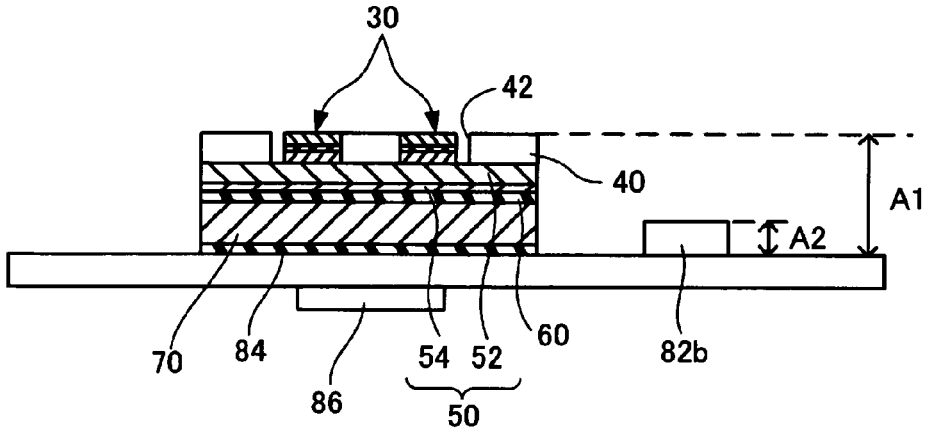
FIG. 3 is a schematic cross-sectional view showing a coil unit along a line A-A in FIG. 2.
Figure 4:
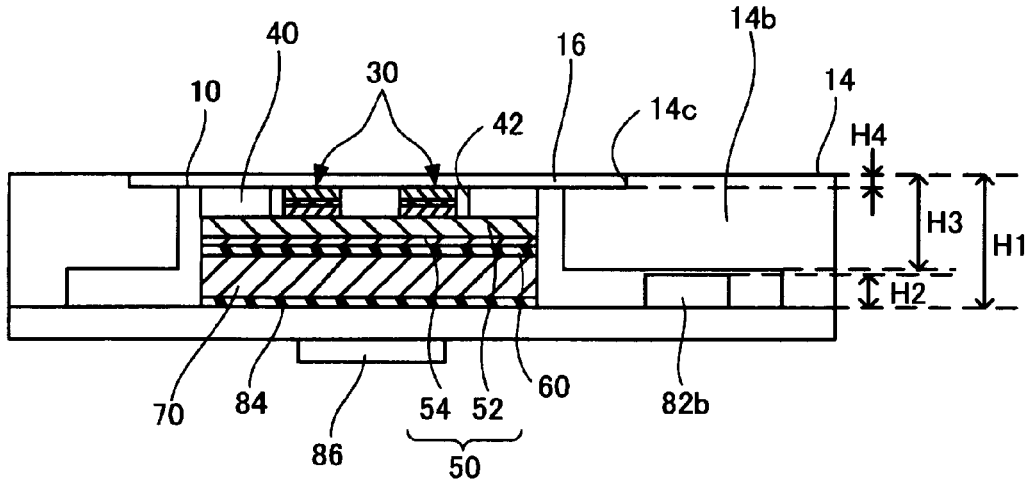
FIG. 4 is a view schematically showing a partial cross section of a charger or a charging target including a coil unit.

FIG. 2 is a schematic exploded oblique view showing the coil units 12 and 22. FIG. 3 is a schematic cross-sectional view showing the coil units 12 and 22 along the line A-A shown in FIG. 2. FIG. 4 is a view schematically a partial cross section of the charger 10 or the charging target 20 including the coil unit 22.

The coil units 12 and 22 are formed in a state in which a heat sink 70, a shielded magnetic member 50, and a coil (e.g., planar coil 30) are successively stacked on a printed circuit board 80.

The planar coil 30 is not particularly limited insofar as the planar coil 30 is a flat (planar) coil. For example, an air-core coil formed by winding a single-core or multi-core coated coil wire in a plane may be used as the planar coil 30. The planar coil 30 may be formed of one coil, or may be formed by staking coils 32*a* and 32*b*, as shown in FIGS. 2 to 4. Mutual inductance can be utilized in addition to self inductance by connecting the coils 32*a* and 32*b* in series. This makes it possible to reduce the diameter of the coil. When providing the coils 32*a* and 32*b*, the coils 32*a* and 32*b* may be secured using a double-sided adhesive tape 34.

A spacer member 40 may be provided around the planar coil 30. A hole 42 is formed in the spacer member 40, and the planar coil 30 is placed in the hole 42. A cut portion 44 is formed in the spacer member 40. A lead line of the planar coil 30 passes through the cut portion. The upper side of the planar coil 30 is substantially flush with the upper side of the spacer member 40. The transmission side can be made flat by providing the spacer member 40. Moreover, breakage of the planar coil 30 (particularly the edge of the planar coil) can be reduced. The spacer member 40 also prevents a member from being caught by the edge of the planar coil 30 so that the planar coil 30 can be prevented from being removed. The material for the spacer member 40 is not particularly limited insofar as the material has excellent resistance to heat generated from the coil and does not have a dielectric constant. For example, a polyethylene terephthalate resin may be used as the material for the spacer member 40.

The shielded magnetic member 50 is provided under the planar coil 30. The shielded magnetic member 50 includes a magnetic member 52 and a magnetic flux leakage prevention member 54 provided under the magnetic member 52.

The magnetic member 52 has a function of receiving a magnetic flux and increasing inductance. A soft magnetic material is preferable as the material for the magnetic member 52. A soft magnetic ferrite material or a soft magnetic metal material may be used as the material for the magnetic member 52.

The magnetic flux leakage prevention member 54 absorbs a magnetic flux which cannot be absorbed by the magnetic member 52 or leaks from the magnetic member 52. Or, when a magnetic flux produced by the planar coil 30 is referred to as a first magnetic flux, the first magnetic flux enters the magnetic member 52, and a second magnetic flux produced by the magnetic member 52 based on the first magnetic flux enters the magnetic flux leakage prevention member 54. In this case, the magnetic flux leakage prevention member 54 absorbs the second magnetic flux.

The material for the magnetic flux leakage prevention member 54 is not particularly limited insofar as the material can absorb a magnetic flux. For example, a non-magnetic material such as aluminum may be used as the material for the magnetic flux leakage prevention member 54. The transmission characteristics are affected by a member formed under the magnetic member in contact with the magnetic member. Therefore, it is preferable to specify the material and size of the magnetic flux leakage prevention member 54 depending on the desired transmission characteristics. Since the magnetic flux does not leak to the heat sink 70 or the like provided under the magnetic flux leakage prevention member 54 by providing the magnetic flux leakage prevention member 54, occurrence of induction heating due to a metal used for the heat sink 70 or the like can be prevented.

The heat sink 70 is provided under the magnetic flux leakage prevention member 54 through an insulating double-sided adhesive tape 60. The heat sink 70 dissipates heat generated from the planar coil 30. The material for the heat sink 70 is not particularly limited insofar as the material has a high thermal conductivity. A metal such as aluminum (Al) may be used as the material for the heat sink 70. Since the heat sink 70 contacts the planar coil 30 through the magnetic member and the magnetic flux leakage prevention member 54, the heat sink 70 can dissipate heat generated from the planar coil 30.

When the heat sink 70 has substantially the same planar size as the magnetic flux leakage prevention member 54, it is preferable that the heat sink 70 have a thickness larger than that of the magnetic flux leakage prevention member 54. A magnetic flux can be reliably captured by the magnetic leakage member 54 when the heat sink 70 has substantially the same planar size as the magnetic flux leakage prevention member 54. Moreover, the heat dissipation capability of the heat sink 70 can be increased by forming the heat sink 70 to have a thickness larger than that of the magnetic flux leakage prevention member 54.

Since the magnetic flux leakage prevention member 54 is insulated from the heat sink 70 by providing the magnetic flux leakage prevention member 54 and the heat sink 70 through the insulating double-sided adhesive tape 60, the heat sink 70 does not affect the transmission characteristics. Specifically, when the insulating double-sided adhesive tape 60 is not provided, the heat sink 70 functions similarly to the magnetic flux leakage prevention member 54 and affects the transmission characteristics. The magnetic flux leakage prevention member 54 and the heat sink 70 can be reliably separated from the viewpoint of function by electrically insulating the magnetic flux leakage prevention member 54 from the heat sink 70 by providing the insulating double-sided adhesive tape 60. Therefore, an arbitrary material can be selected for the heat sink 70 without affecting the transmission characteristics. As a result, this embodiment increases the degree of freedom relating to selection of the material for the heat sink 70. As the insulating double-sided adhesive tape 60, a known insulating double-sided adhesive tape may be used.

The heat sink 70 is secured on the printed circuit board 80 through a double-sided adhesive tape 84. Mounted components 82*b* are provided on the printed circuit board 80, and conductive patterns which connect the mounted components 82*b* and the planar coil 30 is formed on the printed circuit board 80. Examples of the mounted components 82*b* include capacitors C1 and C2 (charger) disclosed in FIG. 1 of JP-A-2005-6460 and capacitors C3 and C4 (charging target) disclosed in FIG. 1 of JP-A-2005-6460. This type of capacitor is formed of a film capacitor, for example.

A temperature detection element 86 (e.g., thermistor) which detects the temperature of the planar coil 30 is provided on the back side (side opposite to the side on which the heat sink 70 is provided) of the printed circuit board 80. The temperature detection element 86 can detect an abnormality when the temperature of the coil increases to a large extent due to insertion of a foreign object. Power transmission may be stopped when the temperature detection element 86 has detected an abnormal temperature of the planar coil 30. An element which disconnects the planar coil 30 from the power supply when the temperature of the heat sink 70 has exceeded a given value may be provided instead of the temperature detection element 86. As such an element, a fuse element which is melted at a high temperature, a thermistor of which the resistance increases at a high temperature to suppress or block current, or the like may be used.

The heat sink 70 is provided between the planar coil 30 and the printed circuit board 80, as described above. As shown in FIG. 3, an upper side position A1 of the planar coil 30 can be easily set to be higher than a maximum height A2 of at least one mounted component by the thickness of the heat sink 70. When the upper side position A1 of the planar coil 30 can be set to be higher than the maximum height A2 of at least one mounted component, the module can be easily assembled. Moreover, the upper side of the planar coil 30 can be brought closer to the other coil unit.

The relationship between a casing 14 and the coil unit is described below with reference to FIG. 4.

The casing 14 has a hole 14*c* formed in the surface opposite to the planar coil 30. The hole 14*c* is covered with a protective cover 16. A reinforcing section 14*b* is formed in the casing 14 at a position opposite to the maximum height position of the mounted component 82*b*. A thickness H3 of the reinforcing section 14*b* is larger than a thickness H4 of the protective cover 16. The transmission distance can be reduced by reducing the thickness of the protective cover 16 and increasing the thickness of the reinforcing section 14*b*. Moreover, the mounted components can be reliably protected by the reinforcing section. The reinforcing section 14*b* also prevents the casing 14 from depressing over the mounted component 82*b* so that the casing can be made flat near the transmission side.

When the height of the outer surface of the protective cover from the circuit board is referred to as H1, the maximum height of the mounted component 82*b* with respect to the printed circuit board 80 is referred to as H2, and the thickness of the reinforcing section is referred to as H3, H1>H2+H3 may be satisfied. This provides a space between the mounted component 82*b* and the reinforcing section 14*b*, whereby breakage of the mounted component 82*b* can be prevented.

As shown in FIG. 2, a positioning section such as a positioning hole 82*a* is formed in the printed circuit board 80 at a position adjacent to a region in which the planar coil 30 is provided. The hole 82*a* facilitates formation of the coil unit as described later.

Manufacturing Method

A method of manufacturing a coil unit is described below with reference to FIGS. 5 to 10.

Figure 5:
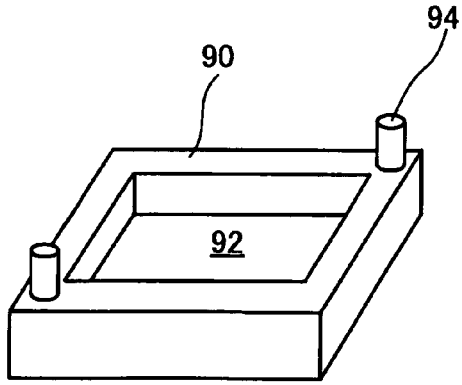
FIG. 5 is a view schematically showing an assembly jig.

An example of manufacturing a coil unit using an assembly jig 90 shown in FIG. 5 is as follows. The assembly jig 90 has a depression 92 which receives the elements of the coil unit. The assembly jig 90 has a positioning guide protrusion 94. The details are given below.

Figure 6:
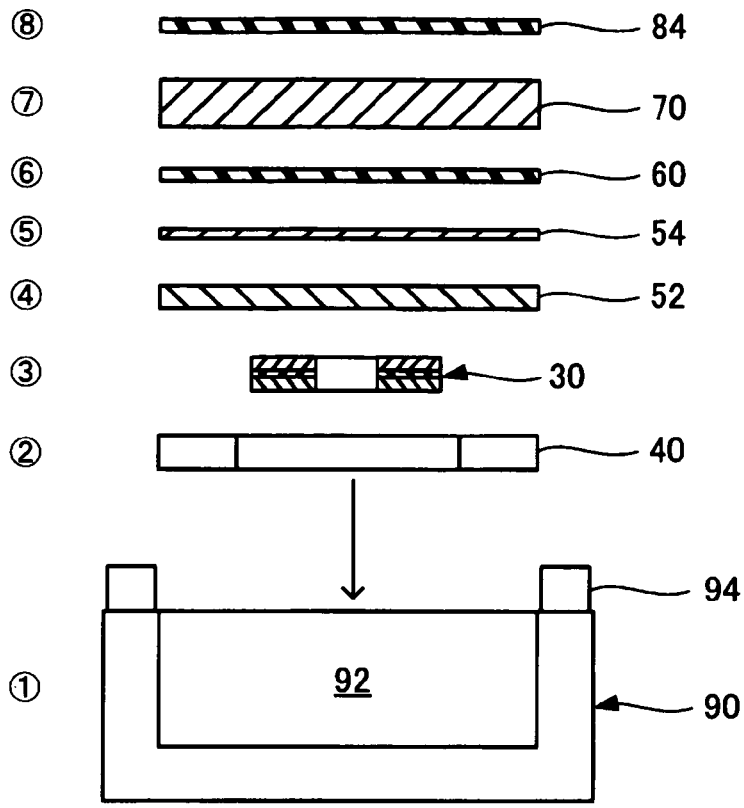
FIG. 6 is a schematic view showing a step of manufacturing a coil unit.
Figure 7:
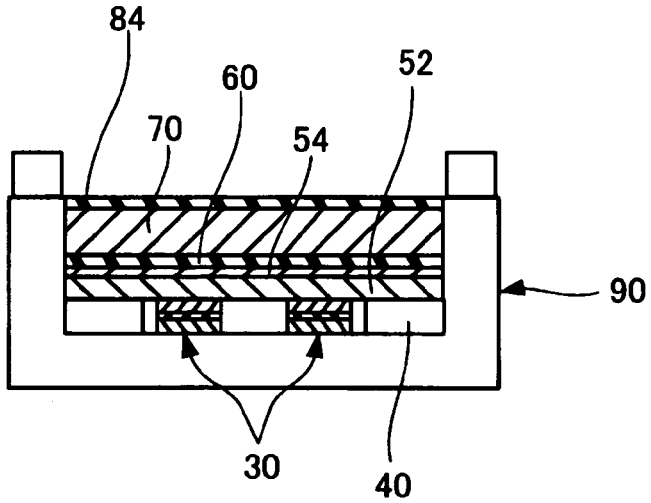
FIG. 7 is another schematic view showing a step of manufacturing a coil unit.
Figure 8:
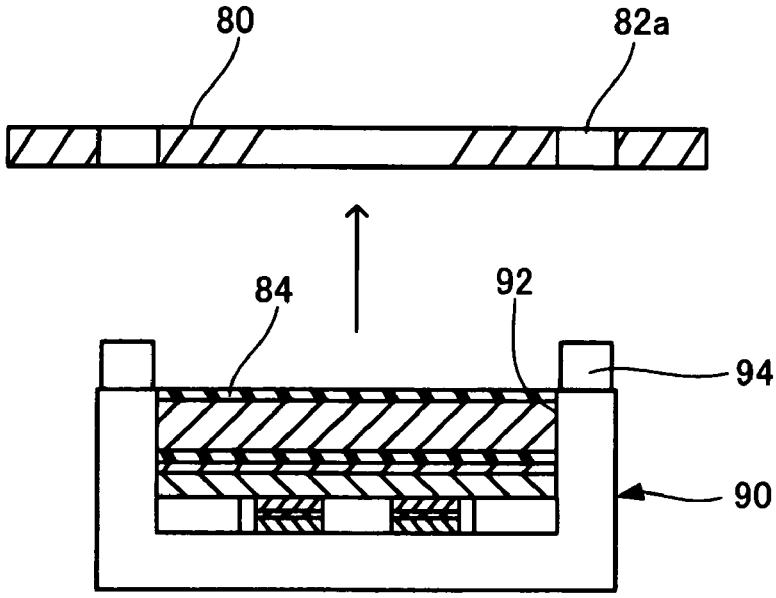
FIG. 8 is another schematic view showing a step of manufacturing a coil unit.
Figure 9:
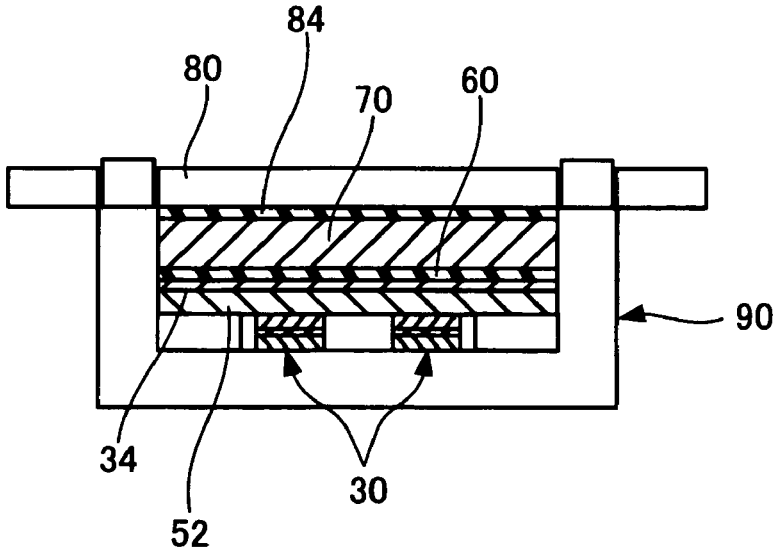
FIG. 9 is another schematic view showing a step of manufacturing a coil unit.
Figure 10:
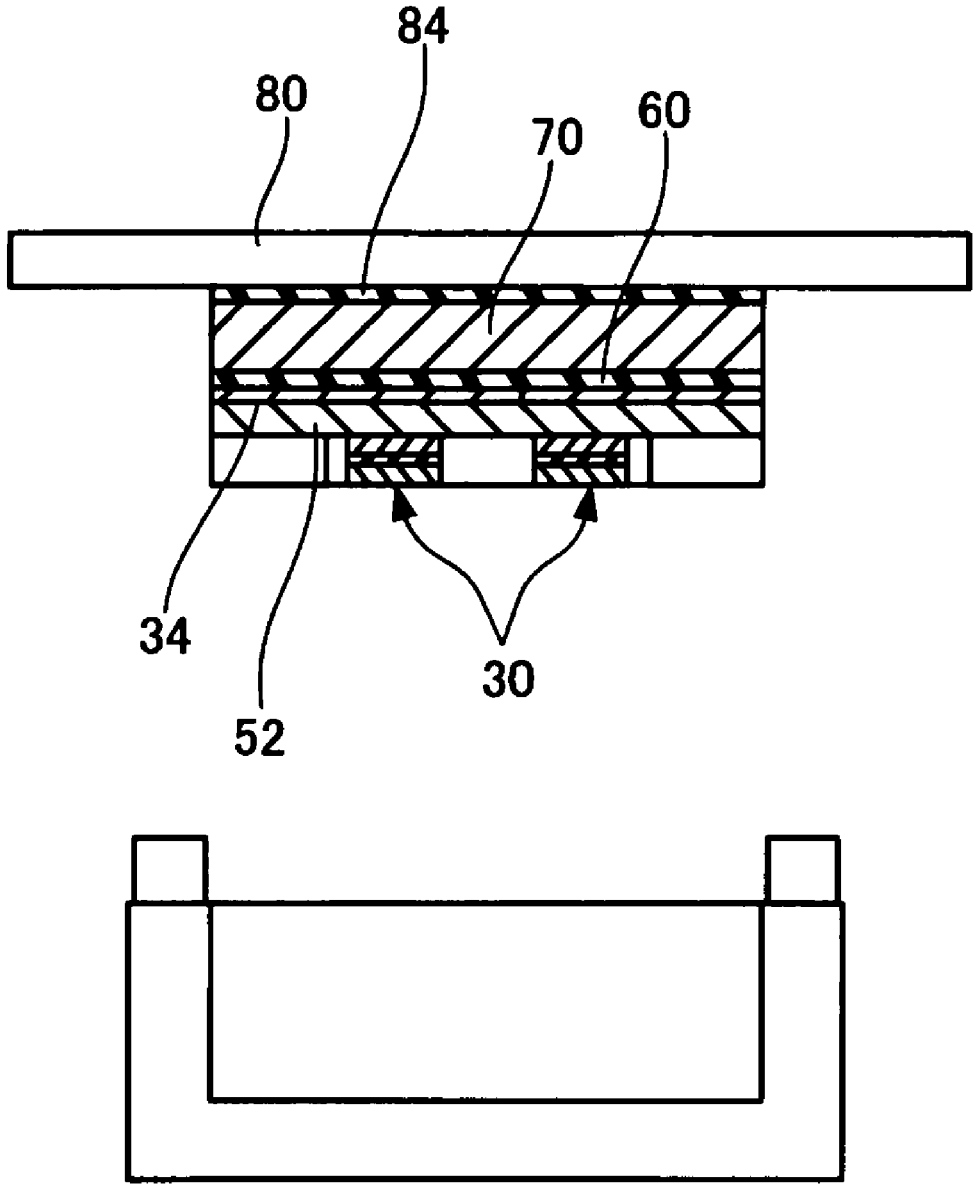
FIG. 10 is a further schematic view showing a step of manufacturing a coil unit.

As shown in FIGS. 6 and 7, the spacer member 40, the planar coil section material 30, the magnetic member 52, the magnetic flux leakage prevention member 54, the insulating double-sided adhesive tape 60, the heat sink 70, and the double-sided adhesive tape 84 are placed in that order in the depression 92 formed in the assembly jig 90. As shown in FIGS. 8 and 9, the printed circuit board 80 is positioned with respect to the assembly jig 90 on the open side of the depression 92 formed in the jig 90. The printed circuit board 80 is positioned with respect to the assembly jig 90 so that the protrusion 94 of the assembly jig 90 is inserted into the positioning hole 82*a* in the printed circuit board 80. This facilitates positioning. The assembly jig is then removed, whereby the elements placed in the assembly jig 90 are secured on the printed circuit board 80 through the double-sided adhesive tape 84.

Application Example of Electronic Instrument

The above embodiments may be applied to an electronic instrument which performs power transmission or signal transmission. For example, the above embodiments may be applied to a charging target including a secondary battery (e.g., wristwatch, electric toothbrush, electric shaver, cordless telephone, personal handyphone, mobile personal computer, personal digital assistant (PDA), or power-assisted bicycle) and a charger which charges the charging target.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term cited with a different term having a broader meaning or the same meaning at least once in the specification and the drawings can be replaced by the different term in any place in the specification and the drawings.

The above embodiments have been described taking an example of non-contact power transmission. Note that the invention may be similarly applied to non-contact signal transmission utilizing an electromagnetic induction principle.

The above embodiments have been described taking an example in which the invention is applied to the coil unit of the charger and the coil unit of the charging target. Note that the invention may be applied to either the coil unit of the charger or the coil unit of the charging target.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. An electronic instrument comprising:

a coil unit, the coil unit comprising:

a planar coil;

a magnetic member that increases an inductance of the planar coil;

a magnetic flux leakage prevention member that absorbs a magnetic flux leaking from the magnetic member;

heat sink;

a printed circuit board having conductive patterns, the heat sink being provided on the printed circuit board and the conductive patterns being connected to the planar coil formed on the printed circuit board; and at least one mounted component provided on the printed circuit board on a side that is provided with the heat sink, an upper side position of the planar coil being set to be higher than an upper side of a mounted component having a maximum height among the at least one mounted component, the magnetic member being provided between the planer coil and the magnetic flux leakage prevention member, the magnetic flux leakage prevention member being provided between the magnetic member and the heat sink, and the magnetic flux leakage prevention member being electrically insulated from the heat sink; and a casing that receives the coil unit, the casing having a hole in a surface that faces the planar coil, the hole being covered with a protective cover;

the casing having a reinforcing section that is formed at a position that faces a maximum height position of the at least one mounted component, the reinforcing section having a thickness larger than that of the protective cover; and when a height of an outer surface of the protective cover from the printed circuit board is referred to as H1, a maximum height of at least one mounted component with respect to the printed circuit board is referred to as H2, and a thickness of the reinforcing section is referred to as H3, H1>H2+H3 being satisfied.

2. The electronic instrument of claim 1, wherein the magnetic flux leakage prevention member is insulated from the heat sink through a double-sided adhesive tape.

3. The electronic instrument of claim 1, wherein a mounted component among the at least one mounted component that has the maximum height is a capacitor that is connected to the planar coil.

4. The electronic instrument of claim 1, the coil unit further includes a temperature detection element that detects a temperature of the heat sink, the temperature detection element being provided on a side of the printed circuit board opposite to a side that is provided with the heat sink.

5. The electronic instrument of claim 1, the coil unit further includes an element that disconnects the planar coil from a power supply based on a temperature of the heat sink, the element being provided on a side of the printed circuit board opposite to a side that is provided with the heat sink.

6. The electronic instrument of claim 1, wherein the printed circuit board has a positioning section that is guided through an assembly jig, the assembly jig receiving the heat sink, the magnetic flux leakage prevention member, the magnetic member, and the planar coil.

7. The electronic instrument of claim 1, the coil unit further including a spacer member that is disposed on an upper side of the magnetic member, the spacer member including a hole that receives the planar coil, an upper side of the planar coil being substantially flush with an upper side of the spacer member.

8. The electronic instrument of claim 1, wherein the magnetic flux leakage prevention member and the heat sink have a substantially identical planar size, and the heat sink has a thickness larger than that of the magnetic flux leakage prevention member.

* * * * *